United States Patent [19]

Kato

[11] 4,117,759

[45] Oct. 3, 1978

[54] APPARATUS FOR FORMING CHORD SIGNAL

[75] Inventor: Hiroshi Kato, Okegawa, Japan

[73] Assignee: Kabushiki Kaisha Kawai Gakki Seisakusho, Hamamatsu, Japan

[21] Appl. No.: 735,213

[22] Filed: Oct. 22, 1976

[30] Foreign Application Priority Data

Dec. 17, 1975 [JP] Japan ..... 50-149433

[51] Int. Cl.[2] ..... G10H 1/00; G10H 5/06

[52] U.S. Cl. ..... 84/1.03; 84/1.01; 84/1.24; 84/DIG. 11; 84/DIG. 12; 84/DIG. 22

[58] Field of Search ..... 84/1.01, 1.03, 1.17, 84/1.24, DIG. 11, DIG. 12, DIG. 22

[56] References Cited

U.S. PATENT DOCUMENTS

| | | | |
|---|---|---|---|
| 3,715,442 | 2/1973 | Freeman | 84/1.01 |
| 3,800,060 | 3/1974 | Hallman, Jr. | 84/1.24 |
| 3,954,039 | 5/1976 | Southard | 84/1.01 |
| 4,055,103 | 10/1977 | Machanian | 84/1.01 |

*Primary Examiner*—Stanley J. Witkowski
*Attorney, Agent, or Firm*—Haseltine, Lake & Waters

[57] ABSTRACT

An arrangement for forming a musical chord signal in which there are provided a frequency divider for root, a frequency divider for minor third, a frequency divider for major third and a frequency divider for fifth or a frequency divider for seventh. These are connected in common and to an input terminal of a tone source signal. The frequency divider for minor third and the frequency divider for major third have a selection circuit for selectively taking out an output signal according to a major chord or a minor chord of music. The input terminal is connected through plural key-switches to the plural tone source signal oscillators. The output terminals of the frequency divider for root, the selective circuit and the frequency divider for fifth or the frequency divider for seventh are connected together through respective gate circuits which are opened and closed by an output pulse signal of a rhythm pulse generator.

5 Claims, 2 Drawing Figures

C (1059.1KHz)
B (999.9KHz)
A# (943.7KHz)
A (890.6KHz)
G# (840.5KHz)
G (793.4KHz)
F# (748.9KHz)
F (706.9KHz)
E (666.9KHz)
D# (629.9KHz)
D (594.6KHz)
C# (561.2KHz)
SIGNAL OSCILLATOR
506
426
402
338
301
284
FREQUENCY DIVIDER
SELECTION CIRCUIT
GATE
MIXER
FREQUENCY DIVIDER
ENVELOPE CIRCUIT
FILTER
COUNTER
FILTER CIRCUIT
ENVELOPE FORMING CIRCUIT
PULSE GENERATOR 20
20a
20b
20c
OSCILLATOR
FILTER
20a'
3a-1
PHASE DETECTOR
A
GATE
21-1
21-2
21-3
21-4
21-11
21-12
23-1
23-2
23-3
23-4
23-11
23-12
C (2093 Hz)
22-1
B (1976 Hz)
22-2
A#(1865 Hz)
22-3
A (1760 Hz)
22-4
D (1175 Hz)
22-11
C#(1109 Hz)
22-12
GATE
5-1
5-2
5-3
5-4
5-5
4
4a
SELECTION CIRCUIT
FREQUENCY DIVIDER
3-1
3-2
3-3
3-4
3-5
3-6
506
426
402
338
301
284

APPARATUS FOR FORMING CHORD SIGNAL

BACKGROUND OF THE INVENTION

This present invention relates to apparatus for forming a chord signal in an electronic musical instrument.

Such an arrangement in the past, has provided plural gate circuits connected to plural key-switches. These gate circuits are applied with output signals of plural tone source signal oscillators according to a chord, so that a chord signal may be taken out by opening these gate circuits. Thus, the conventional arrangement is inconvenient in that a large number of gate circuits are needed, and wiring connecting between respective tone source signal oscillators and respective gate circuits becomes complex and costly, and may cause short-circuit trouble.

The present invention has the object of providing apparatus for removing those inconveniences.

Another object of the present invention is to provide an arrangement of the foregoing character which is simple in construction and may be economically fabricated.

A further object of the present invention is to provide an arrangement, as described, which may be readily maintained in service, and has a substantially long operating life.

SUMMARY OF THE INVENTION

The objects of the present invention are achieved by providing that at least a frequency divider for root, a frequency divider for minor third, a frequency divider for major third, and a frequency divider for fifth, or a frequency divider for seventh. These are connected in common to an input terminal for a tone source signal, and the frequency divider for minor third and the frequency divider for major third are provided with a selective circuit for selectively taking out an output signal according to a major chord or a minor chord of music. The novel features which are considered as characteristic for the invention are set forth in particular in the appended claims. The invention itself, however, both as to its construction and its method of operation, together with additional objects and advantages thereof, will be best understood from the following description of specfic embodiments when read in connection with the accompanying drawings.

DESCRIPTION OF THE PREFERRED EMBODIMENTS

Figure 1:
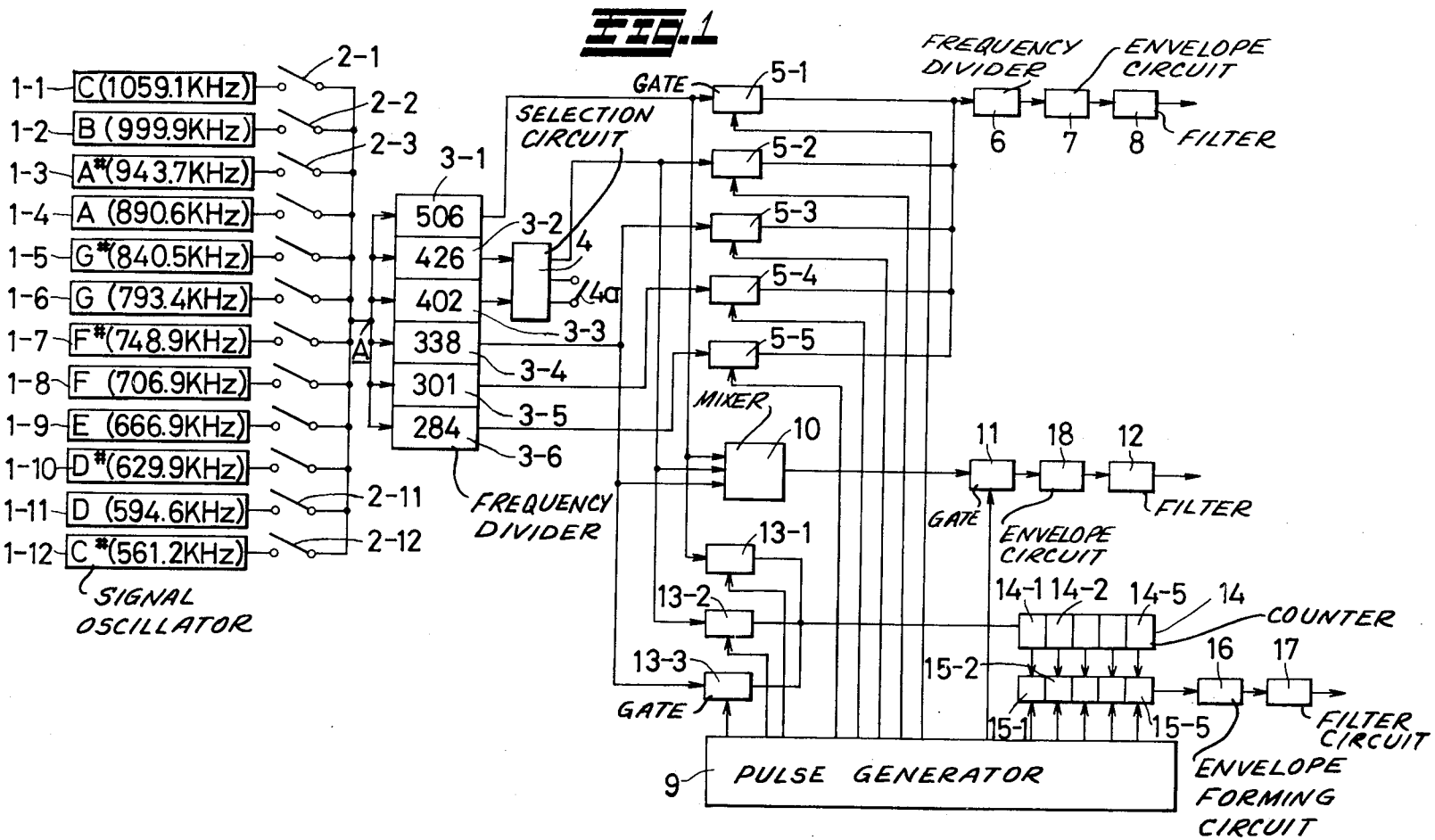
FIG. 1 is a block diagram and shows one embodiment in accordance with the present invention.

Referring to the drawings, (FIG. 1) numerals 1-1, 1-2 . . . 1-12 denote tone source signal oscillators of different oscillation frquencies, and these tone source signal oscillators 1-1, 1-2 . . . 1-12 are connected in common to an input terminal A through respective key-switches 2-1, 2-2 . . . 2-12. The input terminal A is branched off to be connected to plural frequency dividers 3-1 . . . 3-6. The tone source signal oscillators 1-1, 1-2 . . . 1-12 oscillate at comparatively high frequencies corresponding to respective tones of twelve scales as shown in the drawings. As clearly shown in the drawings, the respective frequency dividers 3-1 . . . 3-6 comprises divisions

506, 426 . . . 284 in frequency ratio so that the oscillation frequency of each of the tone source signal oscillators 1-1 . . . 1-2 may be frequency-divided into relations of root, minor third, major third, fifth, sixth and seventh. The frequency dividers for minor third and major third 3-2, 3-3 are provided at their output terminals with a selective circuit 4 for selectively taking out an output of either one according to a minor (Mn) or a major (Mj) of said music. Output terminals of the selective circuit 4 and the frequency dividers 3-1, 3-4, 3-5, 3-6 are connected together through respective gate circuits 5-1 . . . 5-5, and they are further connected to a speaker through a frequency divider for bass tone 6, an envelope circuit 7, a filter circuit 8 and an amplifier (not illustrated). The frequency divider 6 is omitted if a bass tone is not required. Numeral **4*a* denotes a selective switch provided on the selection circuit 4**.

The gate circuits 5-1 . . . 5-5 are connected at their control terminals to a rhythm pattern pulse generator 9 so that the same may be controlled to open and close by a rhythm pulse signal previously programmed in the rhythm pattern pulse generator 9.

If, now, the switch 2-1, for instance, is closed, the frequency dividers 3-1 . . . 3-6 are applied with a signal of the frequency 1059.1 KHz (C), and the signal is frequency-divided, according to the respective frequency dividing ratios, into relations of root, minor third, major third, fifth, sixth and seventh. If the selection switch 4*a* is in its closed condition as illustrated, the signal of the major third is obtained at the output terminal of the selective circuit 4, and thus there is obtained, as a whole, signals of C(Mj). These signals serve to obtain from the speaker, rhythm tones of C(Mj) opening the gate circuits 5-1 . . . 5-5 according to rhythm pulses supplied from the rhythm pattern pulse generator 9.

If the selective switch **4*a* is opened, the signal of minor third is obtained and thereby as a whole rhythm tones of C Mn can be obtained. By, further, selectively closing any of the remainder switches 2-2 . . . 2-12 and by selectively closing the selection switch 4*a***, any of rhythm tones of Mj or Mn in regard to the B . . . C# can be obtained as desired.

Referring to the drawings, numeral 10 denotes a mixing circuit for mixing the output signals of root, third and fifth, and an output terminal thereof is connected to a speaker through a gate circuit 11. The latter is arranged to be opened by a rhythm pulse signal supplied from the rhythm pattern pulse generator 9, and a filter 12, so that the foregoing signals of Mj or Mn can be obtained as a chord. Numeral 18 denotes an envelope circuit.

Numerals 13-1 . . . 13-3 denote gate circuits arranged to be controlled to open and close in order by output pulses of the rhythm pattern pulse generator 9. Input terminals thereof are connected to the output terminals for the signals of root, third and fifth, and output terminals thereof are connected in common for being connected to an input terminal of a counter circuit 14. The counter circuit 14 comprises plural ½ frequency dividers 14-1, 14-2 . . . 14-3 connected in series, and output terminals of these frequency dividers 14-1, 14-2 . . . 14-5 are individually connected to gate circuits 15-1, 15-2 . . . 15-5 arranged to be controlled to open and close in order at every bar of the foregoing rhythm pattern of the rhythm pattern pulse generator 9. Output terminals thereof are connected together to be connected to a speaker through an envelope forming circuit 16 and a filter circuit 17. Accordingly, while the gate circuits 13-1, 13-2, 13-3 are once opened in order, the gate circuit 15-1 is kept open, and while the gate circuits 13-1, 13-2, 13-3 are opened in order in the second place, the gate circuit 15-2 is kept open. Similar operations are carried out one after another in regard to the gate circuits 15-3, 15-4, 15-5, and thus an orpeggio automatic performance can be effected.

It is possible that the foregoing three kinds of the musical tones are simultaneously obtained and that the same are separately obtained.

The above has been explained with reference to the case that musical tone signals of sixth and seventh can be also obtained simultaneously, but these tone signals may be omitted, and they can be so modified that a musical tone signal of seventh is obtained instead of that of fifth.

If, in the embodying example shown in FIG. 1, the oscillators 1-1 . . . 1-12 are arranged to be independently oscillated, an error arises in oscillation frequency and accordingly, it is required to synchronize these oscillators. For satisfying this requirement, such means can be considered that these oscillators 1-1 . . . 1-12 are replaced by frequency dividers so that an oscillation frequency of a main oscillator may be frequency-divided. However, in this case, if the oscillator frequencies obtained at output terminals of these frequency dividers are those shown in FIG. 1, the oscillation frequency of the main oscillator becomes 268.08 MHz by obtaining the greatest common measure of the frequency-dividing ratios of these frequency dividers. Frequency dividers for frequency-dividing such high frequencies as above are costly, and the main oscillator becomes also costly, and therefore these are not practical. An oscillation frequency of a main oscillator owned by a conventional electronic musical instrument such as an electronic organ or the like is 2.0002 MHz at maximum.

Accordingly, in the case where the present invention is built into a conventional electronic musical instrument, the oscillator provided therein cannot be utilized.

Figure 2:
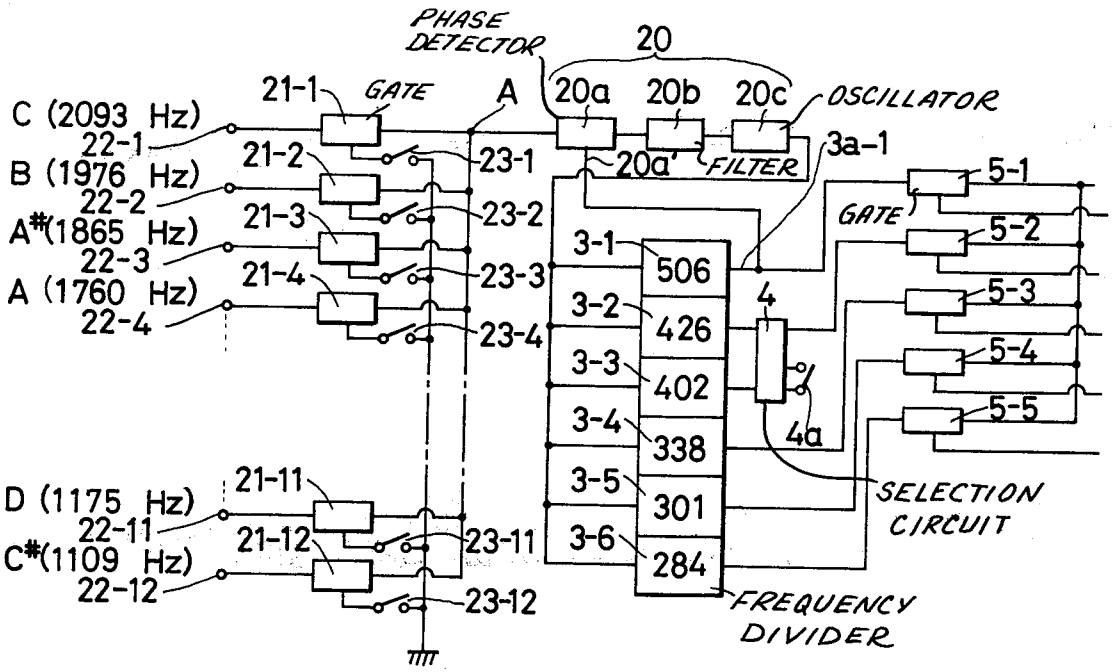
FIG. 2 is a block diagram of another embodiment of the present invention.

A second embodiment shown in FIG. 2, is constructed to avoid this disadvantage. The input terminal A is connected to the respective frequency dividers 3-1 . . . 3-6 through a phase detector **20*a*, a lowpass filter 20*b* and a voltage controlled type oscillator 20*c* connected in series. An output terminal of the frequency divider for root 3-1 is connected to a feed-back signal input terminal 20*a*' of the phase detector 20*a*, and thus a phase-locked loop (called hereafter PLL20) is formed by the combination of the phase detector 20*a*, the lowpass filter 20*b*, the voltage controlled type oscillator 20*c* and the frequency divider for root 3-1**.

If, now, the input terminal A is applied with a signal of a frequency 2093 Hz, this signal is phase-detected and a difference thereof from an input signal applied to the feedback signal input terminal **20*a*' is taken out as an output signal. A voltage signal is obtained therefrom through the filter 20*b* and causes the voltage controlled type oscillator 20*c* to oscillate. The oscillation frequency of the output thereof is applied with and frequency-divided by the frequency dividers 3-1 . . . 3-6. An output signal of the frequency divider for root 3-1 is fed back to the feedback signal output terminal 20*a*'. Thus, the phase detector 20*a* generates a difference signal so that the two input signals may become equal to each other in frequency and cause oscillation of the voltage controlled type oscillator 20*c*. Thus, when the oscillation frequency of the oscillator 20*c* becomes 1059.1 KHz, the frequency divider for root 3-1 becomes 2093 Hz in its output frequency because the frequency-dividing ratio thereof is 506, so that, the difference between the two input frequencies of the phase detector 20*a* becomes zero, and thereby the PLL 20 is locked. Accordingly, the frequency 1059.1 KHz is applied to the respective frequency dividers 3-1 . . . 3-6, so that there can be obtained at output terminals of these frequency dividers 3-1 . . . 3-6**, signals of relations of root, minor third, major third, fifth, sixth and seventh in relation to the C tone.

When a frequency 1976 Hz is applied to the input terminal A, and thereby the voltage controlled type oscillator **20*c* oscillates at a frequency 999.856 KHz, an output of the frequency divider for root 3-1 becomes 1976 Hz and the PLL 20** is locked. As a result, there can be obtained signals having relations of root, minor third, major third, fifth, sixth and seventh in relation to the B tone.

Thus, by applying musical tone signals of respective tones C, B, . . . C, C# to the input terminal A there can be obtained at output terminals of the frequency dividers 3-1 . . . 3-6 signals having relations of root, minor third, major third, fifth, sixth and seventh in relation to respective tones. Thus, the input terminal A is diverged to form respective input terminals 22-1 . . . 22-12 led out through respective gate circuits 21-1 . . . 21-12, and these terminals 22-1 . . . 22-12 are connected to output terminals of respective oscillators provided in a conventional electronic musical instrument. Consequently, be properly closing switches such as key-switches 23-1 . . . 23-12, for instance, connected to control terminals of the gate circuits 21-1 . . . 21-12, the respective gate circuits 21-1 . . . 21-12 are correspondingly opened, whereby musical tone signals can be obtained having relations of root, minor third, major third, fifth, sixth and seventh in relation to the input signal.

The musical tone signals thus obtained become musical tone signals in major or minor by the selective operation of the selection switch **4*a* as described above in connection with FIG. 1**.

Thus, according to the present invention, a musical tone signal is applied to a frequency divider for root, a frequency divider for minor third, a frequency divider for major third, and a frequency divider for fifth, or a frequency divider for seventh so as to be frequency-divided. Thereby, musical tone signals having relations of root, minor third, major third and fifth or seventh in relation to the applied input tone signal can be simultaneously obtained, so that the apparatus can be extremely simplified in circuit construction in comparison with the conventional apparatus. Musical tone signals in minor or major can be simply obtained by selecting either of the musical tone signal of minor third and the musical tone signal of major third.

Without further analysis, the foregoing will so fully reveal the gist of the present invention that others can, by applying current knowledge, readily adapt it for various applications without omitting features that, from the standpoint of prior art, fairly constitute the essential characteristics of the generic or specific aspects of this invention, and therefore, such adaptations should and are intended to be comprehended within the meaning and range of equivalents of the following Claims.

What is claimed is:

1. Apparatus for forming a chord signal comprising in combination: at least a frequency divider for root, a frequency divider for minor third, a frequency divider for major third and a frequency divider for fifth or a frequency divider for seventh, tone signal means connected to input terminals of said frequency dividers, the input terminals of said frequency dividers being connected together, the frequency divider for minor third and frequency divider for major third having a selection circuit for selectively taking out an output signal according to a major chord or a minor chord of music, the tone source signal from said tone source signal means being frequency-divided by the frequency dividers for root, minor third, major third and fifth or seventh for producing musical tone signals for chord, gate circuits, and a rhythm pulse generator, respective output terminals of the frequency divider for root, the selective circuit and the frequency divider for fifth or the frequency divider for seventh being connected together through respective ones of said gate circuits, said gate circuits having means for opening and closing said gates by an output pulse signal of said rhythm pulse generator.

2. Apparatus for forming a chord signal as claimed in claim 1, including plural key-switches and plural tone source signal oscillators, said input terminals, being connected through said plural key-switches to said plural tone source signal oscillators.

3. Apparatus for forming a chord signal as claimed in claim 1, including a circuit for connecting said output terminal of said tone source signal means to plural input terminals of said frequency divider for root, said frequency divider for minor third, said frequency divider for major third and frequency divider for fifth or the frequency divider for seventh has a phase detector, a low-pass filter and a voltage controlled type oscillator connected in series with one another, an output terminal of said frequency divider for root being connected to a feedback signal input terminal of the phase detector, whereby a phase-locked loop is formed by the combination of said phase detector, said low-pass filter, said voltage controlled type oscillator and said frequency divider for root.

4. Apparatus for forming a chord signal as claimed in claim 3, wherein said input terminals are diverged to form additional plural input terminals having respective key-switches, said plural input terminals being connected to output terminals of musical tone signal oscillators of an electronic musical instrument.

5. Apparatus for forming a chord signal as claimed in claim 1 including plural key-switches and plural tone source signal oscillators, said input terminals being connected through said plural key-switches to said plural tone source signal oscillators, gate circuits, a rhythm pulse generator, respective output terminals of the frequency divider for root, the selection circuit and the frequency divider for fifth or the frequency divider for seventh being connected together through respective ones of said gate circuits, said gate circuits having means for opening and closing said gate circuits by an output pulse signal of said rhythm pulse generator, a single common circuit connected between the input terminals and the frequency dividers and having a phase-locked loop, said phase-locked loop having a feed back signal input terminal connected to an output terminal of said frequency divider for root, said input terminals being diverged to form additional plural input terminals having respective key-switches, said plural input terminals being connected to output terminals of musical tone signal oscillators of an electronic musical instrument.

* * * * *